US005604321A

United States Patent [19]

Patrician et al.

[11] Patent Number: 5,604,321

[45] Date of Patent: Feb. 18, 1997

[54] TUNGSTEN-LANTHANA ALLOY WIRE FOR A VIBRATION RESISTANT LAMP FILAMENT

[75] Inventors: Thomas J. Patrician, Monroeton; Harry D. Martin, III, Troy, both of Pa.

[73] Assignee: OSRAM Sylvania Inc., Danvers, Mass.

[21] Appl. No.: 507,184

[22] Filed: Jul. 26, 1995

[51] Int. Cl.[6] ..... B22F 5/12; C22C 27/04

[52] U.S. Cl. ..... 75/248; 75/235

[58] Field of Search ..... 75/235, 248

[56] References Cited

U.S. PATENT DOCUMENTS

| | | | |
|---|---|---|---|
| 3,086,103 | 4/1963 | Hackman et al. | 219/74 |
| 3,159,908 | 12/1964 | Anders | 29/182.5 |
| 3,434,811 | 3/1969 | Foldes | 29/182.5 |
| 3,443,143 | 5/1969 | Koo | 313/311 |
| 3,927,989 | 12/1975 | Koo | 29/182.5 |
| 4,923,673 | 5/1990 | Litty | 419/20 |
| 4,950,327 | 8/1990 | Eck et al. | 75/232 |
| 5,148,080 | 9/1992 | Van Thyne | 313/345 |
| 5,284,614 | 2/1994 | Chen et al. | 419/20 |

*Primary Examiner*—Ngoclan Mai

*Attorney, Agent, or Firm*—Robert F. Clark

[57] ABSTRACT

A wire for fabrication of a vibration resistant filament for an incandescent lamp. The wire includes about 0.05–1.00 weight percent lanthanum oxide dispersed in a tungsten matrix and has a microstructure including stringers of fine particles of lanthanum oxide extending parallel to the wire axis. During primary recrystallization of a vibration resistant lamp filament from the filament wire, the stringers produce a microstructure in the filament exhibiting sufficient grain boundary segments extending generally axially along the length of the filament to render the filament resistant to vibration. A method for producing a vibration resistant filament for an incandescent lamp is also disclosed.

6 Claims, 5 Drawing Sheets

TUNGSTEN-LANTHANA ALLOY WIRE FOR A VIBRATION RESISTANT LAMP FILAMENT

CROSS-REFERENCES TO RELATED APPLICATIONS

This application is related to co-pending application Ser. No. 08/507,183, filed Jul. 26, 1995, pending.

BACKGROUND OF THE INVENTION

The present invention relates to wire for fabricating lamp filaments, particularly to such wire fabricated from a tungsten alloy, and to processes for producing the alloy and the wire.

A filament for an incandescent lamp with high vibration resistance must have a microstructure specifically tailored to resist fracture caused by vibration of the lamp. Such vibration resistant microstructures typically include a high proportion of elongated grains oriented in the longitudinal (axial) direction, with several elongated grains across the diameter of the filament wire and long segments of grain boundaries running parallel to the filament wire axis. This type of microstructure is distinct from an equiaxed microstructure, which exhibits only short segments of grain boundaries running parallel to the wire axis. The abundant long grain boundaries in the highly vibration resistant microstructure act effectively as vibration dampeners, reducing the tendency of the filament wire to fracture.

The microstructure of a filament for a highly vibration resistant lamp is also different from that of a standard incandescent lamp. The standard incandescent lamp performs best when the filament during operation has a good non-sag microstructure. A typical non-sag microstructure is characterized by being largely free of grain boundaries, with an occasional wire segment including a long grain boundary running parallel to the wire axis. This type of non-sag microstructure is called an interlocking grain structure.

Prior to the present invention, three types of wire have been used for vibration resistant lamp filaments: a type of non-sag wire having a degraded non-sag microstructure, a tungsten-based wire including 3 weight percent rhenium, and a tungsten-thorium oxide wire. The degraded non-sag wire is the most readily fabricated and least expensive of the alternatives. However, it is used only for the least severe applications, since it does not perform as well as the other alternatives. The tungsten-rhenium wire is used for applications where the filament temperature is the highest, and for alternating current applications where the wire diameter is finer than for typical direct current applications. Tungsten-thoria wire is used for most other applications because it performs well and is less expensive than the tungsten-rhenium wire. However, the thorium in the tungsten-thoria wire is a radioactive material. Because of the radioactivity of thoria, the cost of manufacturing the alloy is increased. Care must be taken at each step to limit exposure of the workers to radioactive dust. Additionally, scrap generated in the process must be disposed of as low level radioactive waste in an appropriate disposal site. Thus the disposal cost is much higher than that for non-radioactive tungsten scrap, which can be recycled.

It would be desirable to have a readily fabricated, relatively inexpensive lamp filament of non-radioactive materials exhibiting excellent vibration resistance at high operating temperatures. The filament wire described herein was developed to address that need.

SUMMARY OF THE INVENTION

In one embodiment, the invention is a wire for fabrication of a vibration resistant filament for an incandescent lamp. The wire includes about 0.05–1.00 weight percent lanthanum oxide dispersed in a tungsten matrix, and has a microstructure including stringers of fine particles of lanthanum oxide extending parallel to the axis of the wire.

In another embodiment, the invention is a vibration resistant filament for an incandescent lamp. The filament includes about 0.05–1.00 weight percent lanthanum oxide dispersed in a tungsten matrix. The filament is fabricated from a wire having a microstructure including stringers of fine particles of lanthanum oxide extending parallel to the filament axis. After primary recrystallization, the stringers produce a microstructure in the filament exhibiting sufficient grain boundary segments extending generally axially along the length of the filament to render the filament resistant to vibration.

In yet another embodiment, the invention is a method for producing a vibration resistant filament for an incandescent lamp. The method involves preparing a tungsten-based powder containing particles of a lanthanum compound reducible to lanthanum oxide. A sintered ingot is produced from the tungsten-based powder such that the lanthanum compound particles are converted to lanthanum oxide particles, the amount of the lanthanum compound particles in the tungsten-based powder being selected to produce about 0.05–1.00 weight percent lanthanum oxide particles in the sintered ingot. A wire is drawn from the ingot, the lanthanum oxide particles being broken up during the drawing process to form stringers of smaller particles of lanthanum oxide extending parallel to the axis of the wire. A filament is shaped from said wire, and is heated to the primary recrystallization temperature of the wire to produce a vibration resistant microstructure in the filament. In a narrower embodiment, the preparation of the tungsten-based powder involves homogeneously blending a tungsten powder with about 0.06–1.17 weight percent lanthanum hydroxide powder to form the tungsten-based powder. In another narrower embodiment, the preparation of the tungsten-based powder involves mixing tungsten blue oxide powder into a solution of a soluble lanthanum salt to form a suspension in which the tungsten blue oxide powder is thoroughly wet by the solution. The suspension is then dried to provide a tungsten blue oxide powder doped with the lanthanum salt. Tungsten powder containing lanthanum oxide then may be produced by heating the doped tungsten blue oxide powder in a hydrogen atmosphere at a temperature and for a time sufficient to reduce the doped tungsten blue oxide powder to a tungsten-based powder containing lanthanum oxide particles. The amount of lanthanum salt in the lanthanum salt solution is selected to provide sufficient lanthanum to produce at least a preselected amount of about 0.05–1.00 weight percent of the lanthanum oxide particles in the tungsten-based powder. If necessary, the amount of lanthanum oxide particles in the tungsten-based powder is decreased to achieve the preselected amount of said lanthanum oxide particles by mixing with the tungsten-based powder a sufficient amount of tungsten powder. An ingot is then pressed from the lanthanum oxide containing tungsten-based powder and sintered to form the sintered ingot.

BRIEF DESCRIPTION OF THE DRAWINGS

For a better understanding of the present invention, together with other objects, advantages, and capabilities thereof, reference is made to the following Description and appended claims, together with the Drawings in which:

DETAILED DESCRIPTION OF THE PREFERRED EMBODIMENTS

An exemplary embodiment of the lamp filament in accordance with the invention is described herein. The lamp filament wire is fabricated from a tungsten-lanthanum oxide alloy, that is, a tungsten metal with lanthanum oxide dispersed throughout the tungsten base. Preferably, the tungsten raw material has a purity greater than about 99.9% by weight tungsten, more preferably, greater than 99.96%. Thus, the matrix is essentially pure tungsten with all unavoidable impurities in solution in the tungsten matrix. Also preferably, the lanthanum oxide raw material has a purity greater than about 99.9 weight % lanthanum oxide, more preferably, greater than 99.95%, and a particle size less than about 3 μm. The lanthanum oxide may be present in the tungsten in an amount of 0.05–1.00%, preferably 0.08–0.70%, most preferably 0.15–0.45%, all percents expressed in percent by weight.

The lanthanum oxide is homogeneously distributed throughout the tungsten metal by processes described in more detail below, then consolidated to produce an ingot of the alloy. Metalworking techniques used to draw the alloy into a filament wire cause the lanthanum oxide particles to break up in such a way that the final wire product exhibits stringers of smaller oxide particles extending in the direction of deformation of the wire during the metalworking process, i.e., generally parallel to the wire axis. The term "stringers", as used herein, is intended to mean a line of minute oxide particles spaced slightly apart from one another in the matrix.

Figure 1A:
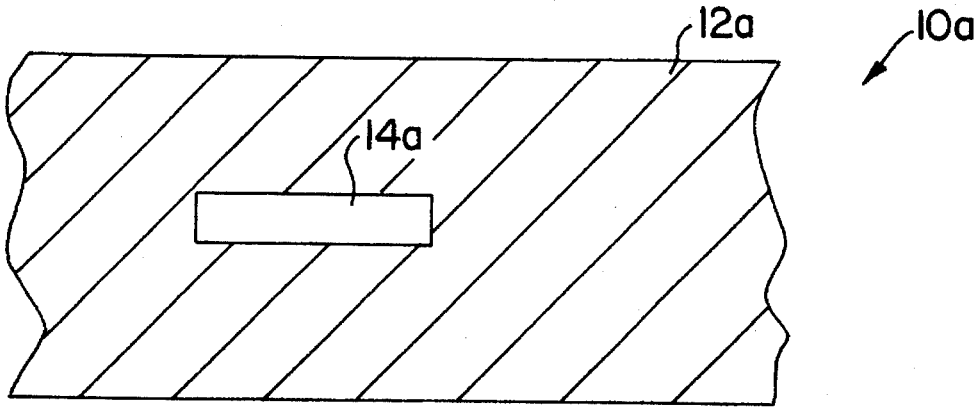
FIGS. 1A–1D are schematic axial cross-sectional elevation views of a filament wire in accordance with one embodiment of the invention, illustrating the formation of a single typical stringer of lanthanum oxide particles in a tungsten matrix during deformation.
Figure 1B:
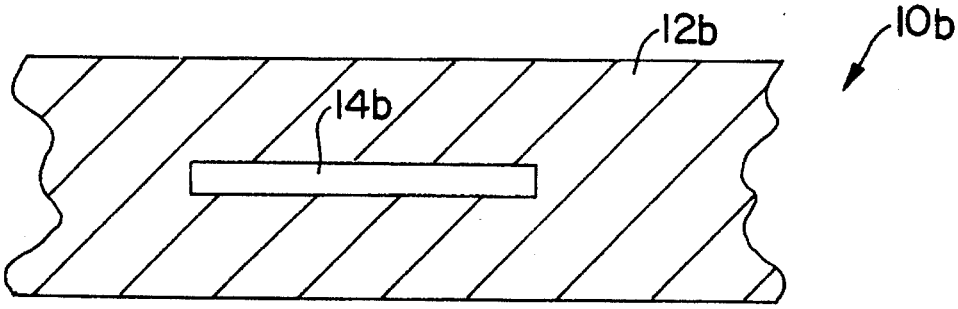
Figure 1C:
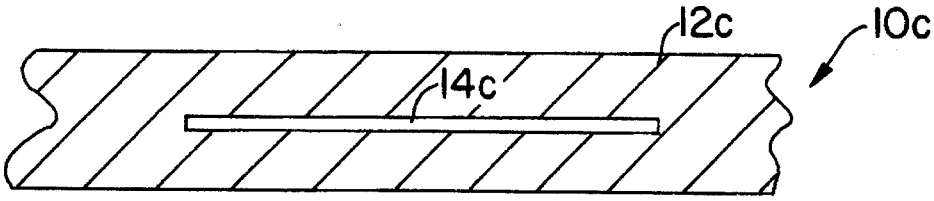
Figure 1D:
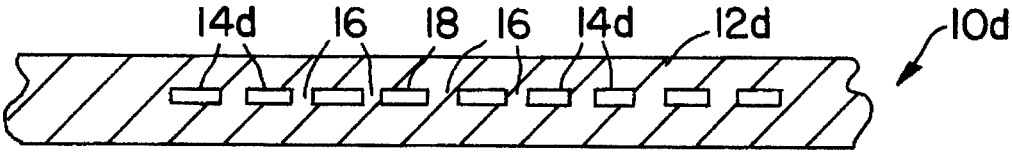

FIGS. 1A–1D, not drawn to scale, schematically illustrate axial cross sections of typical sections of tungsten-lanthana filament wire showing how a single stringer is formed during deformation. FIG. 1A shows shaped tungsten-lanthana rod **10*a* before deformation, including matrix 12*a* and unbroken lanthana crystal 14*a*. FIG. 1B shows slightly deformed rod 10*b* after one or more initial rolling or swaging steps, showing deformed, elongated lanthana crystal 14*b* in tungsten matrix 12*b*. FIG. 1C shows wire 10*c*, the product of further drawing steps carried out on rod 10*b*; FIG. 1C shows further deformed and elongated, but still unbroken lanthana crystal 14*c*. FIG. 1D shows filament wire 10*c* after still further drawing steps, showing that lanthana crystal 14*c* has broken up, forming minute lanthana particles 14*d*. Particles 14*d* are separated by spaces 16 and are generally axially aligned within matrix 12*d* to form stringer 18**. Because the lanthana crystal is deformed and elongated before breaking up, the minute lanthana particles are small and uniform in size, are separated by relatively uniform small spaces, and are nearly perfectly aligned with one another in the axial direction. The particles of the stringers are so minute that normally they are difficult to resolve under an ordinary microscope at fine wire sizes. It is preferred that the lanthanum oxide particles in the filament wire should all be less than about 1 μm in diameter with many of the particles being <0.5 μm in diameter.

It is these stringers of lanthanum oxide particles that determine the metallurgical microstructure of the filament during operation of a lamp. The oxide stringers pin grain boundaries during primary recrystallization, leaving many grain boundaries with segments parallel to the wire axis. The primary recrystallized microstructure is thus the desired structure for a lamp filament exhibiting excellent vibration resistance.

This stringer formation is similar to that found in the above-mentioned tungsten-thoria alloy. In spite of this, however, the tungsten-lanthana filament wire described herein and its properties present an unexpected improvement over the tungsten-thoria wire. As shown in Table I, the properties of lanthanum oxide are significantly different from those of thorium oxide and, as shown in Table II, the properties of the tungsten-lanthanum oxide wire are significantly different from those of the tungsten-thorium oxide wire. The significantly lower melting point of lanthana compared to that of thoria makes it more difficult to sinter. Additionally, the lower melting point would lead one to expect adjustments in filament light-up sequences with the tungsten-lanthana wire. One would also tend to expect a high rate of failure in the tungsten-lanthana wire due to the lower melting temperature. Further, the lower melting point of lanthana would lead one to expect difficulty in its use in filament wires for vibration resistant lamps, e.g., those operating at 2000° C.

The different properties of the tungsten-lanthana filament wire from the tungsten-thoria wire are largely a result of their different microstructures which are, in turn, the result of the different properties of lanthana and thoria.

TABLE I

| PROPERTY | THORIA | LANTHANA |
|---|---|---|
| Melting point, °C. | 3220° | 2307° |
| Crystal structure | cubic | rhombohedral |
| Density, 6/cm$^3$ | 9.86 | 6.51 |
| Stability in $H_2$ | above 3220° C. | below 2000° C. |

TABLE II

| PROPERTIES | W-THORIA WIRE | W-LANTHANA WIRE |
|---|---|---|
| Oxide particle size | inconsistent: some particles > 1 μm | very consistent: no particles > 1 μm |
| Radioactivity | yes | no |
| Recrystallization temperature, °C.: | 1800°/2100° | 2000°/2300° |

TABLE II-continued

| PROPERTIES | W-THORIA WIRE | W-LANTHANA WIRE |
|---|---|---|
| primary/secondary | | |
| Breakage during coiling process | high | very low |
| Lamp performance | good | comparable to W-thoria in initial testing |

Figure 2A:
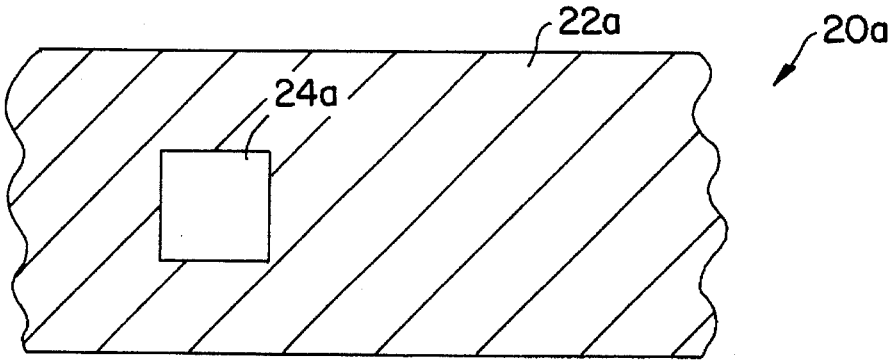
FIG. 2A PRIOR ART
FIGS. 2A–2D are schematic axial cross-sectional elevation views of a prior art-filament wire, illustrating the formation of a typical stringer of thorium oxide particles in a tungsten matrix during deformation.
Figure 2B:
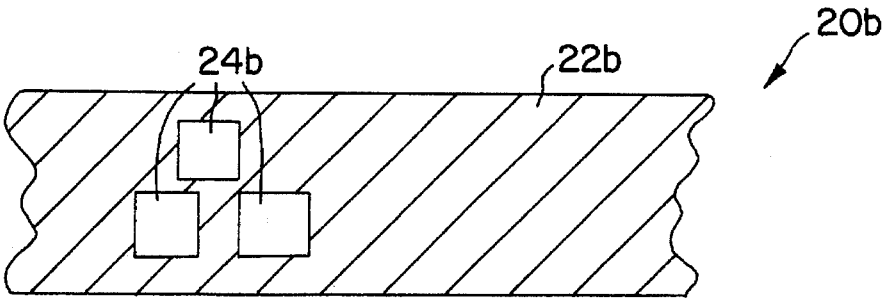
FIG. 2B PRIOR ART
Figure 2C:
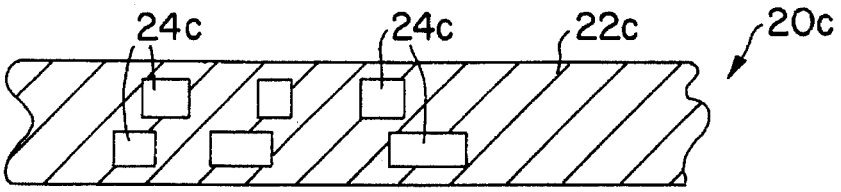
FIG. 2C PRIOR ART
Figure 2D:
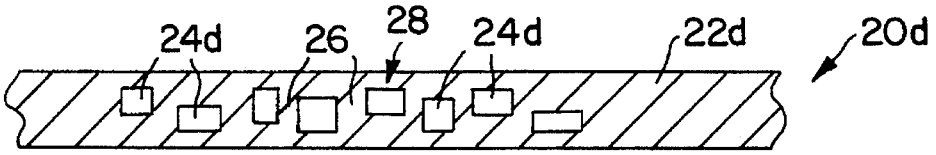
FIG. 2D PRIOR ART

FIGS. 2A–2D, also not drawn to scale, schematically illustrate axial cross sections of typical sections of tungsten-thoria filament wire showing, in a manner similar to that of FIGS. 1A–1D, how a single stringer is formed during deformation. FIG. 2A shows shaped tungsten-thoria rod 20*a* before deformation, including matrix 22*a* and unbroken thoria crystal 24*a*. FIG. 2B shows slightly deformed rod 20*b* after one or more initial deformation steps, showing breaking up of thoria crystal 24*a* earlier in the deformation process than occurs with the lanthana crystal shown in FIGS. 1A–1D. Thoria crystal 24*a* forms smaller thoria crystals 24*b* in tungsten matrix 22*b*. FIG. 2C shows wire 20*c*, the product of further drawing steps carried out on rod 20*b*, wire 20*c* exhibiting further broken up, still smaller thoria crystals 24*c*. FIG. 2D shows filament wire 20*c* after still further drawing steps, showing that thoria crystals 24*c* have been even further broken up, forming minute thoria particles 24*d*. Particles 24*d* are non-uniform in size and are separated by non-uniform spaces 26 to form stringer 28. Further, in stringer 28 particles 24*d* have poorer axial alignment within matrix 22*d* than lanthanum oxide because the thoria crystal is broken up early in the deformation process.

Figure 3A:
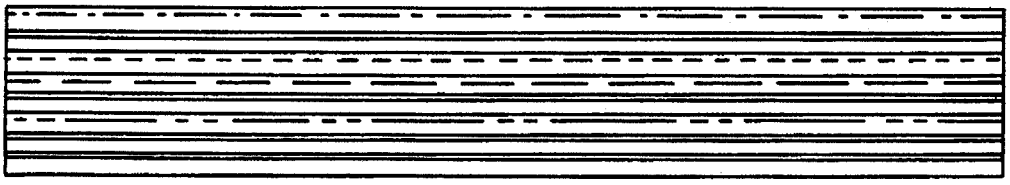
FIGS. 3A–3C are schematic cross-sectional elevation views of a typical oxide-dispersed filament wire in accordance with another embodiment of the invention, illustrating the microstructure which results from stringers of lanthanum oxide particles in an as-drawn filament wire (FIG. 3A) produced during primary (FIG. 3B) and secondary (FIG. 3C) recrystallizations.
Figure 3B:
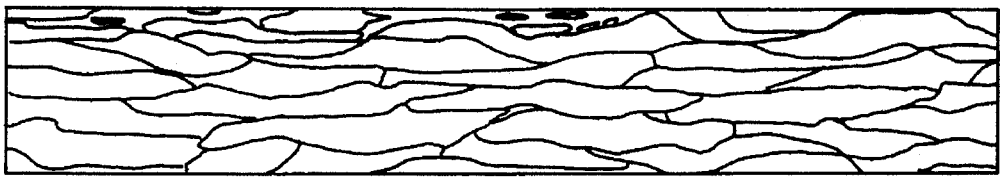
Figure 3C:
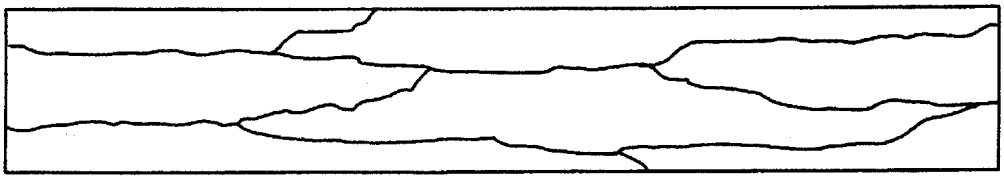

FIGS. 3A–3C, not drawn to scale, illustrate the effect of another difference between the lanthana-doped and thoria-doped tungsten filament wires. FIG. 3A shows an as-drawn filament wire of tungsten resulting from many stringers of lanthanum oxide particles similar to lanthana particle stringer 18 of FIG. 1D. After primary recrystallization at about 2000° C., the microstructure of the wire is changed to that shown in FIG. 3B. That is, during primary recrystallization the lanthanum oxide stringers pin grain boundaries of the tungsten, causing the tungsten to form elongated grains lying parallel to the wire axis, with many grains across the diameter of the wire. The abundance of long grain boundaries running parallel to the wire axis act as effective vibration dampeners, reducing the tendency of the filament wire to fracture during vibration shock. This filament wire is highly vibration resistant, i.e., non-brittle in shock, and fairly low in sag. For a good vibration resistant grain structure, it is preferred to have at least four longitudinal grain boundaries across the filament wire diameter.

If the wire is further heated to its secondary recrystallization temperature of about 2300° C., the microstructure is transformed to that shown in FIG. 3C. Grain growth has consumed the smaller elongated grains, producing a microstructure of large grains with few axial grain boundaries across the diameter of the wire. This microstructure is low in sag, but is too brittle to be resistant to vibration shock. The transformation of the tungsten-thoria filament wire during primary and secondary recrystallizations takes place at lower temperatures, i.e., 1800° C. and 2100° C., respectively, as shown in Table II.

Thus, the tungsten-lanthana filament wire has been found to exhibit a primary recrystallized microstructure that is stable over a wider temperature range, for use in vibration resistant lamps operating at up to about 2000° C. Additionally, the tungsten-lanthana wire is more readily shaped into filament coils for use in lamps than some other filament wire materials.

The preferred method for preparing the tungsten-lanthanum oxide alloy utilizes a dry doping technique. Tungsten powder is blended with an appropriate amount of lanthanum hydroxide ($La(OH)_3$) powder in a high intensity blender (e.g., a high intensity blender manufactured by Littleton/Day of Florence, Ky., Model PMK-300-D) to homogeneously mix the two components. Such high intensity blending is important because it increases the tap density of the powder, which facilitates subsequent filling of the molds used for pressing green bodies. Typically, both the tungsten powder and the blended powder have Fisher Subsieve (FSSS) method particle sizes of about 1.50 μm.

Since the lanthanum hydroxide decomposes to lanthanum oxide upon heating, the amount of lanthanum hydroxide added is selected to yield the desired doping level in the sintered tungsten metal. That is, for each percent by weight of lanthanum oxide desired in the doped tungsten metal, 1.17 weight percent lanthanum hydroxide is added to the tungsten powder. The preferred composition for the doped tungsten metal, also called tungsten-lanthana alloy, is about 0.05–1.00 weight percent, more preferably about 0.08–0.70 weight percent, most preferably about 0.15–0.45 weight percent lanthanum oxide in the tungsten-lanthanum oxide alloy. Thus, about 0.06–1.17 weight percent, more preferably about 0.09–0.82 weight percent, most preferably about 0.18–0.53 weight percent lanthanum hydroxide must be added to the tungsten powder.

Alternatively, the tungsten-lanthanum oxide alloy may be prepared by a wet doping method. Tungsten blue oxide ($WO_{2.8}$) is mixed with a solution of a soluble lanthanum salt until the tungsten blue oxide is thoroughly wet and a slurry is formed. The preferred lanthanum salt is lanthanum nitrate ($La(NO_3)_3.6H_2O$). The suspension of tungsten blue oxide is then stirred and heated until all the liquid is evaporated, resulting in a doped tungsten blue oxide. The amount of lanthanum salt used for doping of the tungsten blue oxide is somewhat higher than that desired in the final product, to compensate for the amount of the lanthanum salt which clings to the surfaces of the mixing vessel. The amount of this excess is not critical, for the reason described below, and may be determined empirically.

The doped tungsten blue oxide is then reduced in a hydrogen atmosphere in, e.g., a standard tube furnace or calciner to produce a tungsten metal powder containing lanthanum oxide. That is, during the reduction process, the lanthanum salt, e.g. lanthanum nitrate, decomposes to produce lanthanum oxide. A typical temperature for this reduction process is about 900° C.

As mentioned above, the amount of excess lanthanum salt added to the tungsten blue oxide slurry is not critical because, after doping, the metal powder is analyzed to determine the lanthanum content. Then, if necessary, the doped powder is blended with an appropriate amount of non-doped tungsten metal powder to achieve the desired lanthanum oxide concentration. Typically, the blended tungsten powder has a particle size, determined by the FSSS method, of about 1.50 μm.

The blended lanthanum-tungsten powder is pressed, presintered, and sintered to form an ingot using conventional techniques, e.g., those used to produce tungsten-thoria alloys. Filament wire is formed from the sintered tungsten-lanthanum oxide ingot using conventional metalworking techniques, i.e., rolling, swaging, and wire drawing techniques, for example, those used to produce tungsten-thoria filament wire. Annealing of the wire is used to recrystallize and stress relieve the alloy at critical points in the metalworking process.

These metalworking steps break up the oxide particles, resulting in a microstructure characterized by the above-described "stringers" of smaller oxide particles extending parallel to the wire axis. It is the grain structure resulting from the presence of these lanthanum oxide stringers in the filament wire microstructure which provide the wire with an unexpectedly high degree of vibration resistance.

The description below of an illustrative embodiment shown in the Drawings is not intended to limit the scope of the present invention, but merely to be illustrative and representative thereof.

Figure 4:
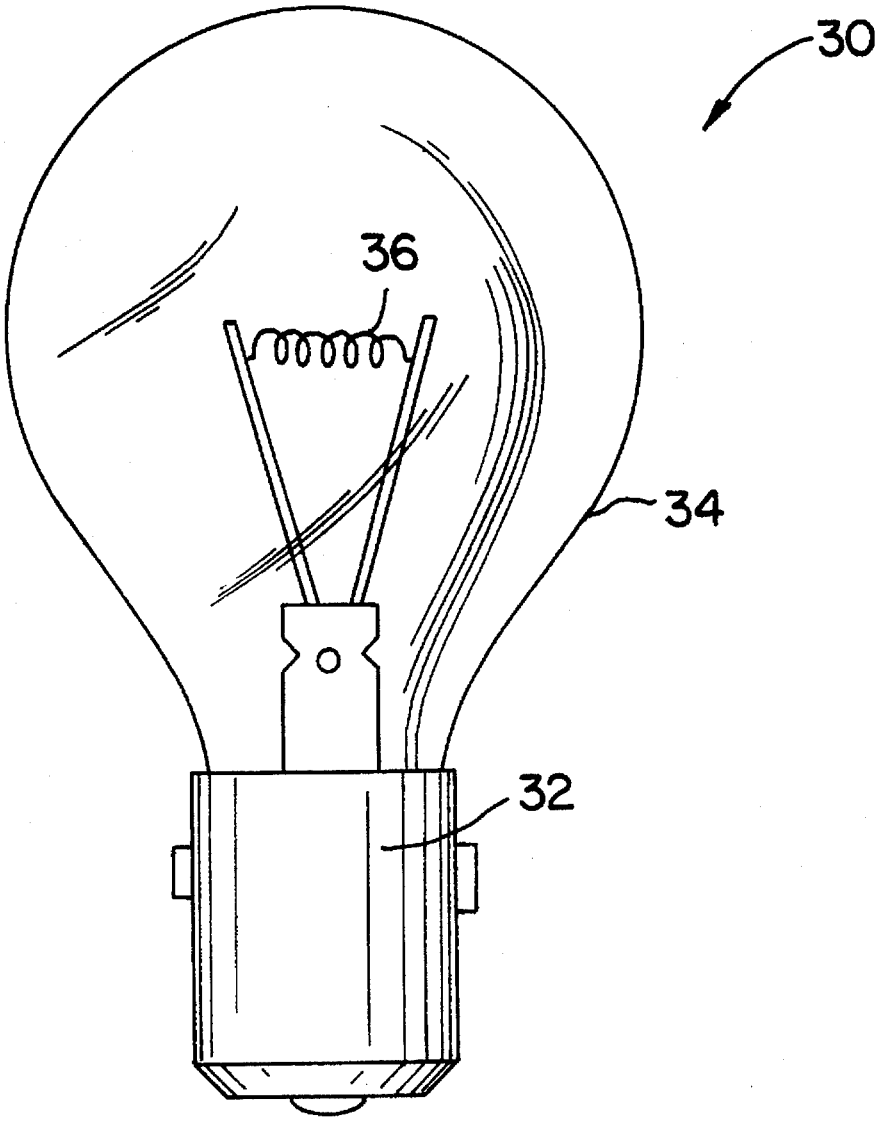
FIG. 4 is an elevation view of a vibration resistant incandescent lamp incorporating a filament in accordance with one embodiment of the present invention.

Referring now to FIG. 4, vibration resistant incandescent lamp 30 in accordance with one embodiment of the present invention includes lamp base 32, light transmissive lamp envelope 34, and coil 36. Coil 36 is shaped of the lanthanum oxide doped tungsten filament wire described above. After primary recrystallization, the oxide stringers in the as-drawn wire produce a microstructure having an abundance of long grain boundaries running parallel to the wire axis, as shown in FIG. 3B. This filament wire renders lamp 30 highly vibration resistant.

The following Examples are presented to enable those skilled in the art to more clearly understand and practice the present invention. These Examples should not be considered as a limitation upon the scope of the present invention, but merely as being illustrative and representative thereof.

EXAMPLE 1

Pure lanthanum oxide ($La_2O_3$) powder is converted to lanthanum hydroxide ($La(OH)_3$) powder by heating in a water saturated atmosphere at 60° C. for 12 hours. The lanthanum oxide powder is exposed to the water vapor until at least 95% of the lanthana is converted to the hydroxide, as measured by the weight gain. During the conversion, there is a volume increase in the powder. The conversion is performed to break up agglomerated lanthana particles and to prevent the occurrence of volume changes in the powder after pressing, which can cause breakup of pressed and/or partially sintered doped tungsten ingots.

Pure tungsten powder (specification given below) is blended with an appropriate amount of lanthanum hydroxide powder for producing a tungsten-0.4% lanthana alloy (weight percent). The powders were blended for 1 hour in a Littleford High Intensity Blender at a blender load of about 300 kg.

The powder mixture was pressed at 35–45 ksi to form 6.0 kg cylindrical ingots of lanthana doped tungsten, each 914 mm long and 27 mm in diameter. The compaction was performed by continuously increasing the pressure to maximum pressure with no stops. The pressure was released immediately upon reaching maximum pressure, with a rapid drop to atmospheric pressure.

Tungsten Powder Specification

| Element: | In Tungsten: | In Blend: |
|---|---|---|
| Maximum ppm: | | |
| Aluminum | 10 | 10 |
| Calcium | 10 | 10 |
| Chromium | 10 | 10 |
| Copper | 10 | 10 |
| Iron | 50 | 50 |
| Magnesium | 5 | 5 |
| Manganese | 5 | 5 |
| Nickel | 20 | 20 |
| Silicon | 20 | 20 |
| Selenium | 3 | 3 |
| Molybdenum | 60 | 60 |
| Sodium | 35 | 35 |
| Potassium | 15 | 15 |
| Carbon | 25 | 25 |
| $H_2O$ | 600 | 600 |
| Maximum value: | | |
| $La_2O_3$, wt. %* | | 0.4 |
| LOR, ppm** | 2200 | 1600 |
| FSSS, μm | 1.4–1.6 | 1.4–1.6 |
| Tap density, g/cm$^3$ | | 7.1–8.0 |

*Based on $La(OH)_3$ content
**LOR = Weight loss on reduction.

Prior to sintering, the pressed ingots were presintered, two at a time, for 20 min at 1300° C. in a push-through muffle furnace to give the ingots added handling strength. The ingots were then sintered in either a push-through muffle furnace or a batch induction furnace. The sintering schedule for the samples sintered in the push-through furnace involved a slow increase in temperature, over a period of 15–20 hours, to 1800° C.; holding at 1800° C. for at least 8 hours; then cooling. A typical sintering schedule for the samples sintered in the induction furnace was slow heating, over a period of about 11 hours, to 1200° C.; holding 2 hours at 1200° C.; slowly increasing the temperature, over a period of 7 hours, to 1800° C., holding 6 hours at 1800° C., and cooling. The sintered density of all samples was 17.60–18.00 g/cm$^3$. The sintered ingot samples produced were pure tungsten-lanthana alloy, with the lanthana content at 0.4 percent by weight.

The sintered ingots were processed by conventional metal working methods to produce a lanthana doped tungsten filament wire for use in vibration resistant lamps.

EXAMPLE 2

Filament wire samples of three tungsten-lanthana alloys prepared in a manner similar to that described in Example 1, W-0.66% lanthana, W-0.40% lanthana, and W-0.25% lanthana, were annealed for 30 seconds at various temperatures, and the tensile strengths of the samples were measured at 20° C. For comparison, similar filament wire samples of a tungsten-1.00% thoria alloy were also annealed for 30 seconds at various temperatures, and the 20° C. tensile strengths of the samples were measured. All percents given above are weight percents. Tungsten-1% thoria includes the same volume percent oxide as tungsten-0.66% lanthana.

Figure 5:
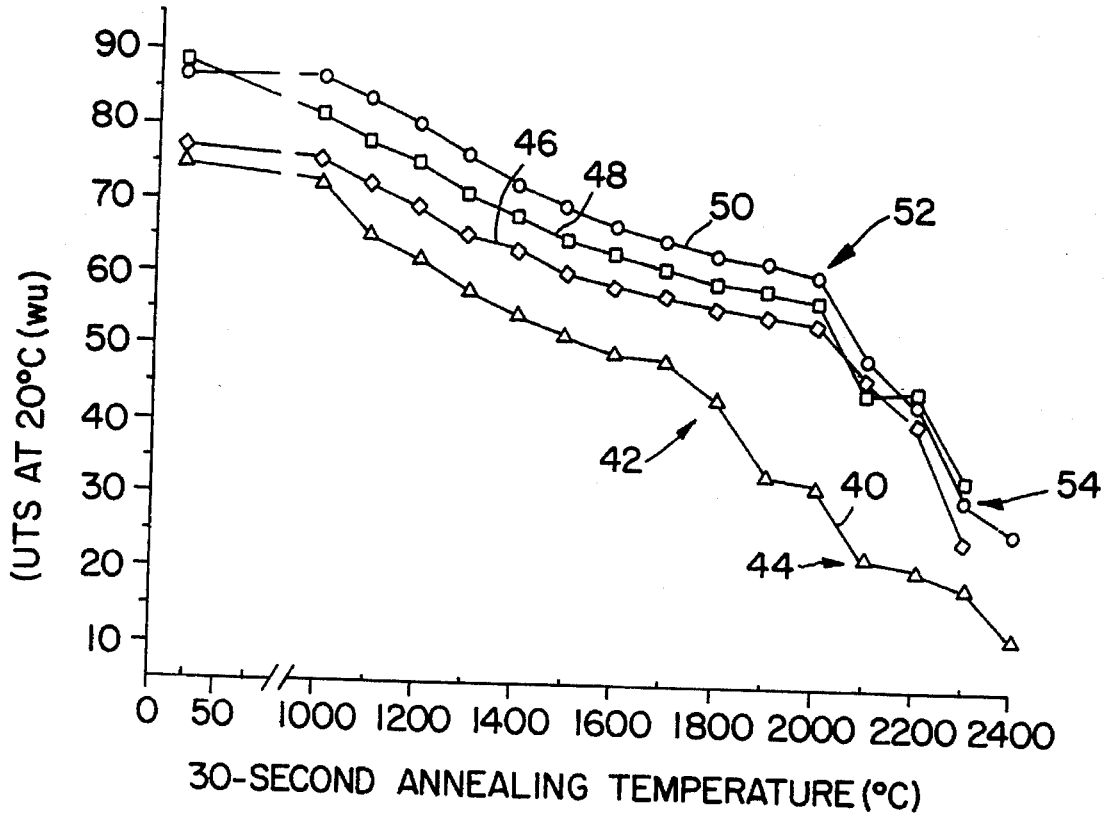
FIG. 5 is a graph illustrating the change in tensile strength with annealing temperature of filament wires in accordance with three embodiments of the invention and one prior art filament wire.

The results are plotted in FIG. 5, which shows the tungsten-thoria alloy, line 40, as the lowest tensile strength material. The tungsten-thoria alloy also has the lowest primary and secondary recrystallization temperatures, shown at arrows 42 and 44, respectively. The W-0.25% lanthana, line 46, W-0.40% lanthana, line 48, and W-0.66% lanthana, line 50, alloys show increasing tensile strength with lanthana content, all three tungsten-lanthana alloys exhibiting greater tensile strength at all annealing temperatures than the tungsten-thoria alloy. Additionally, primary and secondary recrystallization temperatures for all three tungsten-lanthana alloys are significantly higher than the corresponding temperatures for the W-1.00% thoria alloy. See, for example, the primary and secondary recrystallization temperatures shown at arrows 52 and 54, respectively, for the W-0.66% lanthana alloy.

The invention described herein presents to the art a novel tungsten-lanthanum oxide lamp filament wire having excellent vibration resistance without the problems associated with radioactive materials. The tungsten-lanthana alloy filament wire can be coiled more easily than the prior art tungsten-thoria wire. Additionally, the novel tungsten-lanthanum oxide filament wire exhibits greatly improved microstructure and properties over prior art filament wires.

While there has been shown and described what are at present considered the preferred embodiments of the invention, it will be apparent to those skilled in the art that modifications and changes can be made therein without departing from the scope of the present invention as defined by the appended claims.

We claim:

1. A wire for fabrication of a vibration resistant filament for an incandescent lamp, said wire comprising about 0.05–1.00 weight percent lanthanum oxide dispersed in a tungsten matrix, wherein said wire has a microstructure including stringers of fine particles of said lanthanum oxide extending parallel to the axis of said wire.

2. A wire in accordance with claim 1 wherein the fine particles of said lanthanum oxide are less than about 1 μm in diameter.

3. A vibration resistant filament for an incandescent lamp, said filament comprising about 0.05–1.00 weight percent lanthanum oxide dispersed in a tungsten matrix, wherein said filament is fabricated from a wire having a microstructure including stringers of fine particles of said lanthanum oxide extending parallel to the axis of said filament, said stringers producing a microstructure in said filament after primary recrystallization exhibiting sufficient grain boundary segments extending generally axially along the length of said filament to render said filament resistant to vibration.

4. A filament in accordance with claim 3 wherein there are at least four grain boundary segments extending generally axially along the length of said filament.

5. A filament in accordance with claim 3 consisting essentially of 0.08–0.70 weight percent lanthanum oxide, remainder tungsten.

6. A filament in accordance with claim 5 consisting essentially of 0.15–0.45 weight percent lanthanum oxide, remainder tungsten.

* * * * *